US005337065A

United States Patent [19]

Bonnet et al.

[11] Patent Number: 5,337,065

[45] Date of Patent: Aug. 9, 1994

[54] SLOT HYPERFREQUENCY ANTENNA WITH A STRUCTURE OF SMALL THICKNESS

[75] Inventors: Georges Bonnet, Genneviluers; Yves Commault, Paris; Jacques Roquencourt, Cormeilles en Parisis; Alain Sehan, Tregastel, all of France

[73] Assignee: Thomson-CSF, Puteaux, France

[21] Appl. No.: 797,067

[22] Filed: Nov. 25, 1991

[30] Foreign Application Priority Data

Nov. 23, 1990 [FR] France ..... 90 14621

[51] Int. Cl.[5] ..... H01Q 13/10

[52] U.S. Cl. ..... 343/767; 343/700 MS; 343/770

[58] Field of Search ..... 343/767, 700 MS, 778, 343/779, 786, 771; H01Q 1/38, 13/10

[56] References Cited

U.S. PATENT DOCUMENTS

| | | | |
|---|---|---|---|
| 3,172,112 | 3/1965 | Seeley | 343/767 |
| 4,130,822 | 12/1978 | Conroy | 343/700 |
| 4,426,649 | 1/1984 | Dubost et al. | 343/700 MS |
| 4,443,802 | 4/1984 | Mayes | 343/767 |
| 4,587,524 | 5/1986 | Hall | 343/767 |
| 4,710,775 | 12/1987 | Coe | 343/767 |
| 4,775,866 | 10/1988 | Shibata et al. | 343/767 |
| 5,061,943 | 10/1991 | Rammos | 343/778 |

FOREIGN PATENT DOCUMENTS 0295003 12/1988 European Pat. Off. .

OTHER PUBLICATIONS

The 15th Conference of Electrical & Electronics Engineers in Israel Proceedings, Apr. 1987, pp. 1–3; Sabban et al.: "High Efficiency and Gain . . . ".

IEEE Transactions on Broadcasting, vol. 34, No. 4, Dec. 1988, New York US pp. 457–464; Ito et al., "Planar Antennas for Satellite Reception".

*Primary Examiner*—Donald Hajec
*Assistant Examiner*—Tan Ho
*Attorney, Agent, or Firm*—Oblon, Spivak, McClelland, Maier & Neustadt

[57] ABSTRACT

An antenna having a "suspended stripline" structure with two metal plates encircling a dielectric film is disclosed. In this structure, a channel is made for a feeder of a slot with the end of a central conductor of the line penetrating a cavity whose thickness is approximately equal to that of the channel. The slot is made in the upper wall of the cavity.

18 Claims, 9 Drawing Sheets

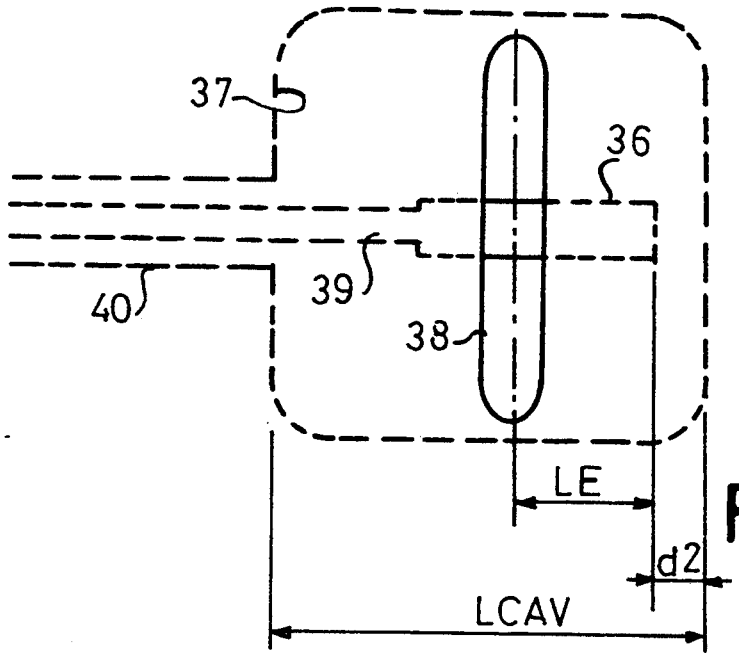
FIG.10
FIG.11A
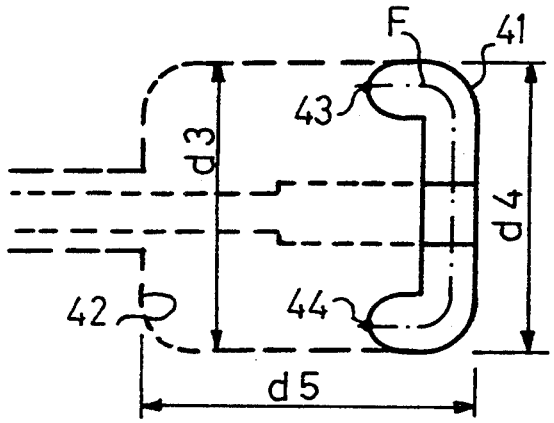
FIG.11B
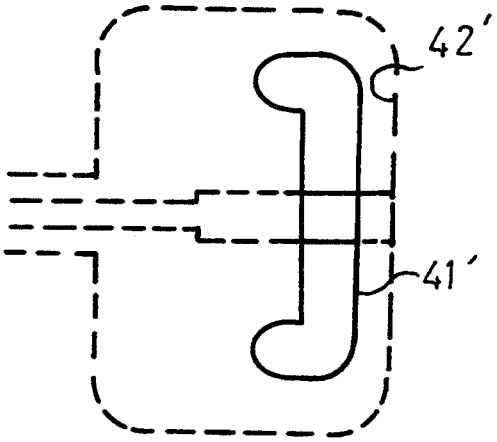
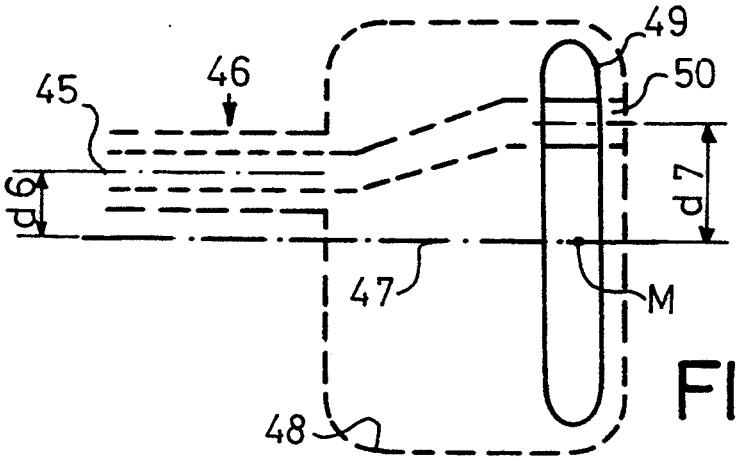
FIG. 12

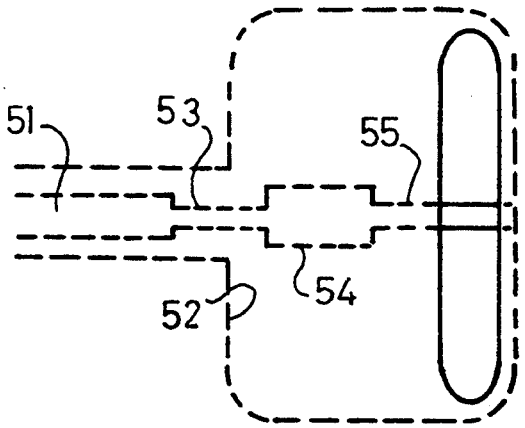
FIG. 13
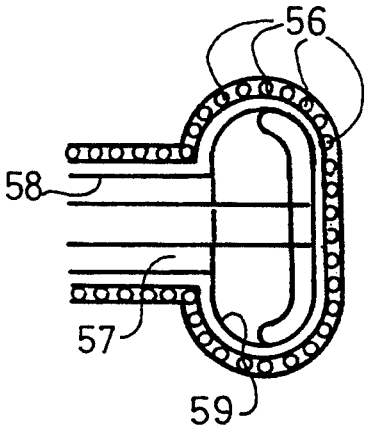
FIG. 14
FIG. 15
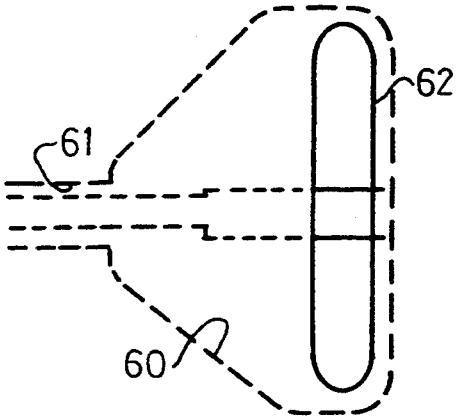
FIG. 16
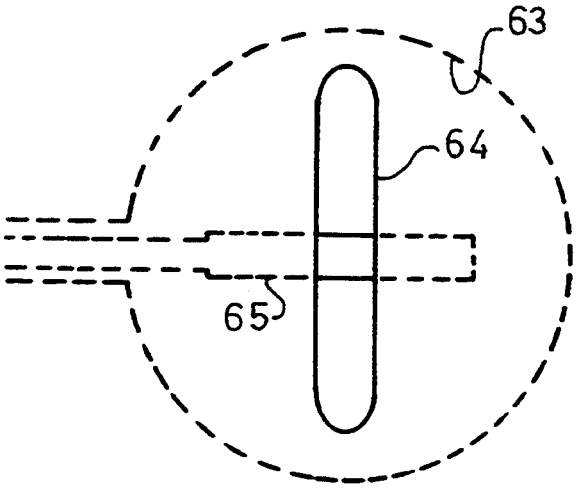

SLOT HYPERFREQUENCY ANTENNA WITH A STRUCTURE OF SMALL THICKNESS

BACKGROUND OF THE INVENTION 1. Field of the Invention

This invention relates to a slot hyperfrequency thin antenna.

2. Discussion of the Background

Flat antennas with radiant slots have been produced in an industrial environment based on a feed structure for waveguides. These embodiments exhibit undeniable qualities at the level of radio performances. On the other hand, the difficulty in constructing the mechanical embodiment leads to a high production cost. Prior attempts to reduce cost have degraded the performance (reduction of the frequency band, . . . ) and decreased the availability of complex functions if the same technology is used.

It is possible to produce flat antennas with a low production cost. For this purpose, the microstrip technology is used in which the radiant elements are formed by discontinuities of the strip: they are designated by the name of radiant patches. The embodiment is simple since it is possible to produce a radiant surface directly by photoengraving. On the other hand, the performance is mediocre compared with the performance of waveguides: significant losses, parasitic radiation of the feeders, etc.

Another technology exists in which it is possible to reduce cost by using photoengraving processes having striplines. In this case, the radiant element is a slot photoengraved in a metal plane and excited by a line according to the process indicated by FIG. 1 (proposed by R. M. Barret and M. H. Barnes in 1951: "Survey of design techniques for flat profiles microwave antennas and arrays, " P. S. Hall and J. R. James, The Radio and Electronic Engineer, Vol. 48 no. 11 pp. 545–565, November 1978, and: "Microwave printed circuits, " R. M. Barret and M. H. Barnes, Radio and TV News, Vol. 46, 1951, p. 16). The modeling and the characterization of this type of radiant element have been performed successively by A. A. Oliner in 1954 ("The radiation conductance of a series slot in strip transmission line, " A. A. Oliner, IRE National Convention Record, 2, Part 8, pp. 89–90 (1954)), R. W. Breithaupt in 1968 ("Conductance data for offset series slots in stripline," R. W. Breithaupt, IEEE Trans-on Microwave Theory and Technique, November 1968, p. 969) and F. S. Rao and B. N. Das in 1978 ("Impedance of off-centered stripline fed series slot, " J. S. Rao and B. N. Das, IEEE Trans. on Antennas and Propagation AP26, November 1978, no. 6, p. 893). As first approximation, the equivalent diagram ordinarily accepted is that of FIG. 2, described below.

An antenna fed by guides whose one end is short-circuited at about one quarter of a wavelength from the end of the core of the strip and whose other end is open on a free half-space by flaring in the shape of a trumpet (see FIG. 6) is further known ("New structures of high-output plane antennas with striplines and suspended striplines," E. Ramos, Radar Symposium, Versailles, May 1984, and: "A plane antenna with lines on suspended substrate for applications of 12 GHz satellite reception," E. Ramos, Acta Electronica, Journal of LEP/Philips, Vol. 27, no. ½ 1985, pp. 77–83). This arrangement leads to a significant thickness for the entire structure; actually, a section for filtering evanescent modes (generated by the free end of the core of the strip) toward the radiant opening is to be added to the quarter-wave section, already mentioned.

SUMMARY OF THE INVENTION

Accordingly, it is an object of the present invention to provide a hyperfrequency antenna whose thickness is as small as possible (for example, less than ¼ of a wavelength), which exhibits the smallest possible hyperfrequency losses, has a low production cost, exhibits the minimum possible parasitic radiation from its feeders, and whose directivity can be adjusted over broad limits.

The present invention also has as its object a slot hyperfrequency antenna network which can integrate a large number of elementary antennas in the most restricted possible space and exhibiting the minimum possible mutual interferences between the hyperfrequency circuits and the feeders of the elementary antennas, and which can be integrable in a metal surface.

The slot hyperfrequency antenna of the invention is formed with its feeder in a structure of "suspended stripline" type, with two plates of electrically conductive material encircling a dielectric film, the end of the core of the line penetrating a cavity in which at least one slot is made, the depth of the cavity being approximately equal to the thickness of the channel of the feeder.

BRIEF DESCRIPTION OF THE DRAWINGS

This invention will be understood better from reading the description of several embodiments, given as non-limiting examples and illustrated by the accompanying drawing, in which:

FIGS. 9, 10, 11A, 11B, and 12 to 17 are diagrammatic top views of various embodiments of a slot antenna according to the invention;

DETAILED DESCRIPTION OF THE PREFERRED EMBODIMENTS

Figure 1:
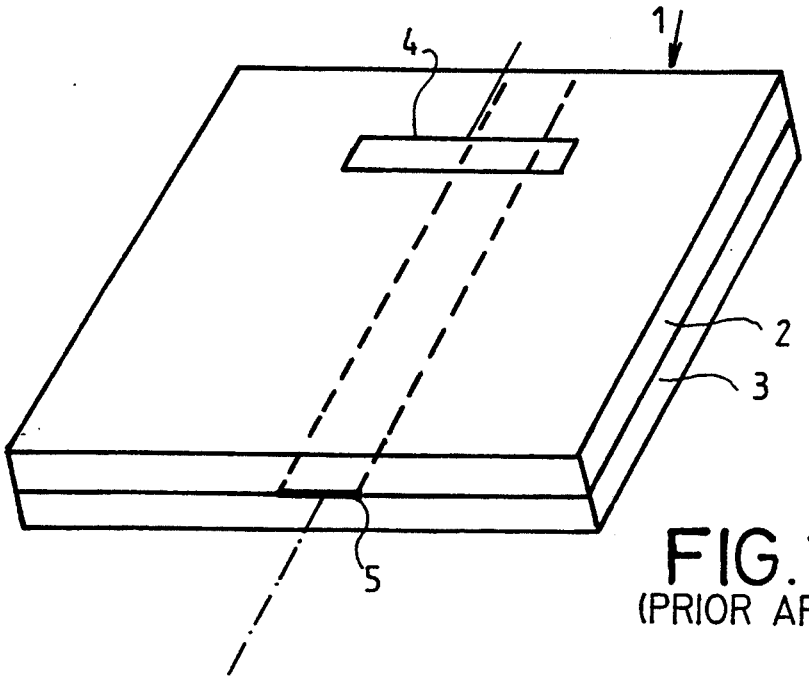
FIG. 1 (PRIOR ART)
FIG. 1 is a diagrammatic perspective view of a slot antenna fed by a stripline, according to the prior art.

The known antenna 1 represented in FIG. 1 is of stripline type with dielectric substrates. It comprises an assembly of two dielectric substrate plates 2, 3. The large outside faces of this assembly are metallized. A slot 4 is photoengraved in one of the metallized surfaces. A metal strip 5 is formed on the large inside face of one of the plates, before their assembly. This strip 5 forms the excitation line of slot 4. As first approximation, the equivalent electrical diagram of such an antenna is that represented in FIG. 2: an inductance L1, in series in a characteristic impedance line Zc, coupled to an inductance L2 which is in parallel with a reactance jB and a pure resistance Yo. Further, the dependence of the impedance exhibited by the slot to the line as a function of the relative position of one relative to the other (offset) is shown.

Figure 3:
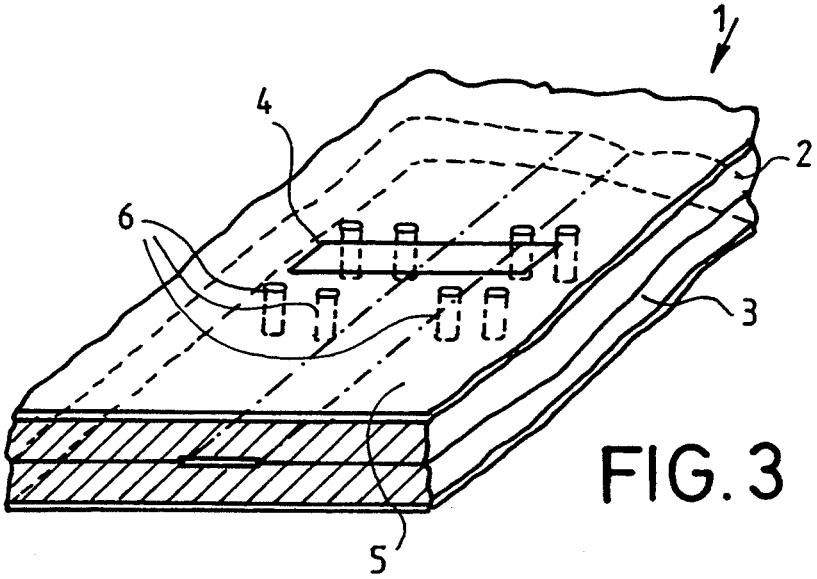
FIG. 3 is a diagrammatic perspective view of another known embodiment of a slot antenna with stripline structure.
Figure 4:
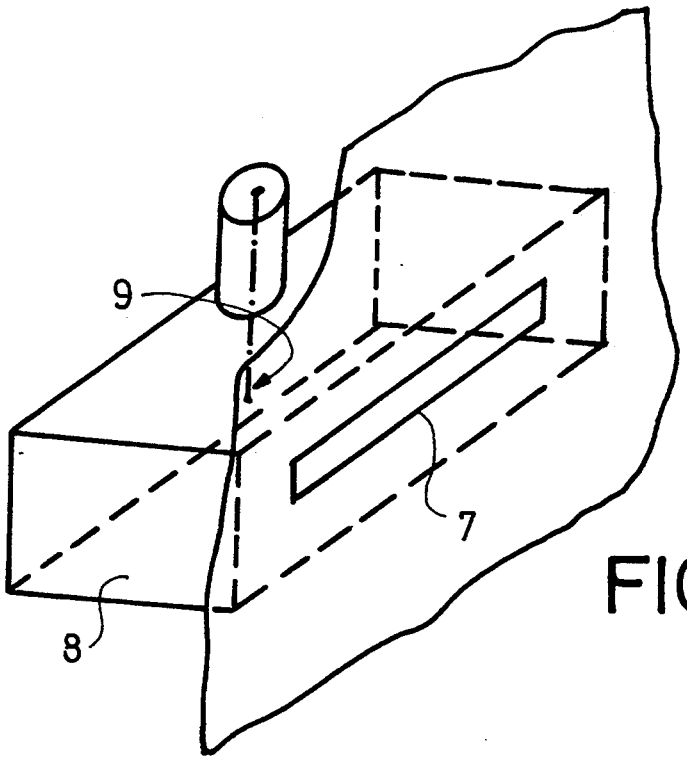
FIG. 4 is a partial perspective view of a known cavity-backed slot antenna.

A major drawback of this type of element is the generation of even mode TEM between the conductive planes (metallized outside faces of plates 2, 3) due to the asymmetrical load exhibited by the slot. It is possible to be free of this drawback only by shielding the coupling zone by inserted metal pillars 6 or metallized holes as shown in FIG. 3. The shield formed by these holes constitutes a cavity ("boxed stripline"). By completely closing this cavity outside the feeder, the constituted radiant element becomes a cavity-backed slot which was the object of a first description by A. T. Adams (Design of transverse slot arrays fed by a boxed stripline," R. Shavit, R. S. Elliot, IEEE Trans. on Antennas and Propagation Vol. AP31 no. 4, July 1983, p. 545). These cavity-backed (8) slots (7), conventionally fed by an axial probe (9) (FIG. 4), have been the object of many studies: theoretical ("The input impedance of the rectangular cavity-backed slot antenna" C. R. Cokrell, IEEE Trans. on Antennas and Propagation, Vol. AP24, no. 3, May 1976, p. 288, and: "Electromagnetic fields coupled into a cavity with a slot-aperture under resonant conditions, " C. C. Liang and D. K. Cheng, IEEE Trans. on Antennas and propagation, Vol. AP30, no. 4, July 1982, page 664), experimental ("Experimental study of the impedance of cavity-backed slot antenna" S. H. Long, IEEE Trans. on antennas and propagation, Vol. AP23 no. 1, January 1975), of optimization ("Optimization of cavities for slot antennas, " ROE, Lagerloef, Microwave journal, Vol 16, no. 10, Oct. 1973, p. 12c), with widened band ("Cavity-backed wide slot antennas, " J. Hirokawa and coauthors, IEE Proc. Vol. 136, Pt. H No. 1, February 1989, p. 29), and a recent work is dedicated to them ("Microwave cavity antennas," A. Kumar and H. D. Hristov, Artech House, 1989, Chap. 2).

Figure 5:
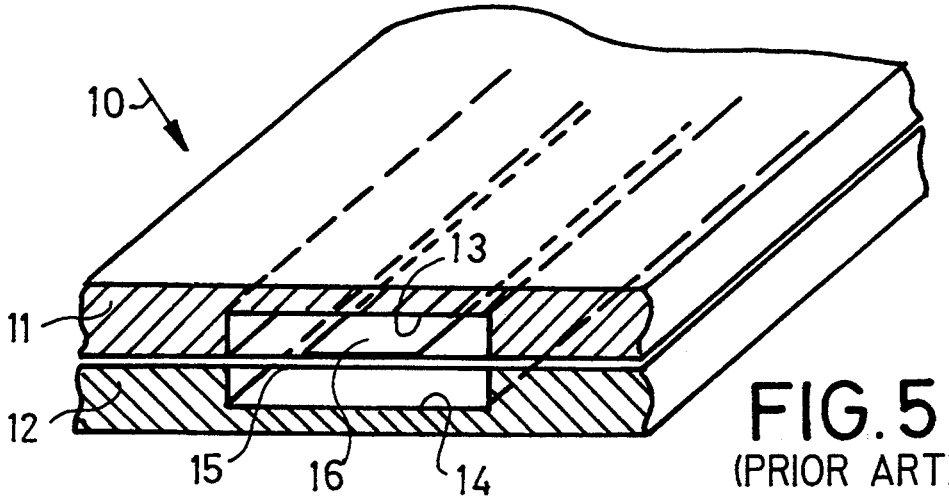
FIG. 5 (PRIOR ART)
FIG. 5 is a partial perspective view of a "suspended stripline," known in the art and used by the invention.

FIG. 5 represents a "suspended stripline" section 10 used in the present invention. This line 10 is formed in a metal structure comprising two plates 11, 12 of electrically conductive material applied against one another. In the faces opposite each of these plates, grooves 13, 14 are respectively formed facing one another. Between the two plates, a film 15 of dielectric material is inserted on at least one face of which a strip 16 of electrically conductive material is formed. This strip 16 is narrower than grooves 13, 14 and, preferably, its longitudinal axis is merged with the longitudinal axis of the grooves. Such a line offers, relative to the line with dielectric substrates of FIG. 1, two significant advantages: smaller losses because of the elimination of dielectric substrates, and a shield between adjacent lines due to the metal structure and the possibility of making metallized holes in film 15. This combination produces, for each line, a channel closed around each strip.

Figure 6:
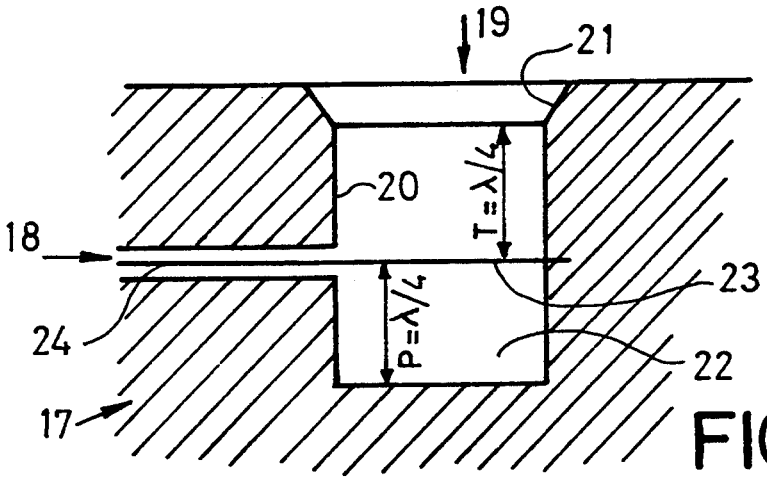
FIG. 6 (PRIOR ART)
FIG. 6 is a view in section of a radiant guide antenna, of cavity-backed "suspended stripline" technology.

In FIG. 6, a known antenna 17 with a radiant opening is represented. This antenna 17 is fed by a "suspended stripline" 18, similar to that of FIG. 5. Line 18 comes out into a cavity 19 with a circular section of a diameter greater than $\frac{1}{2}$ of a wavelength. This cavity 19 includes going from line 18 toward its output orifice, a cylindrical section 20 of length T close to or only slightly different from $\frac{1}{4}$ of the wave and an opening 21 flaring into a trumpet shape. On the opposite side relative to line 18, cavity 19 ends with a cylindrical cavity 22 closed at its end, with depth P close to or very little different from $\frac{1}{4}$ of a wavelength. Core 23 of line 18 ends approximately at the center of the circle formed by the intersection of film 24 of the line and cavity 19, i.e., at $\frac{1}{4}$ of a wavelength of the wall of the cavity. Section 20 is used in filtering upper evanescent modes generated by the free end of core 23 of the strip suspended in large-sized cavity 19. This antenna 17 therefore has a significant thickness structure (greater than $\frac{1}{2}$ of a wavelength), which excludes use in applications requiring a very thin structure.

Figure 7:
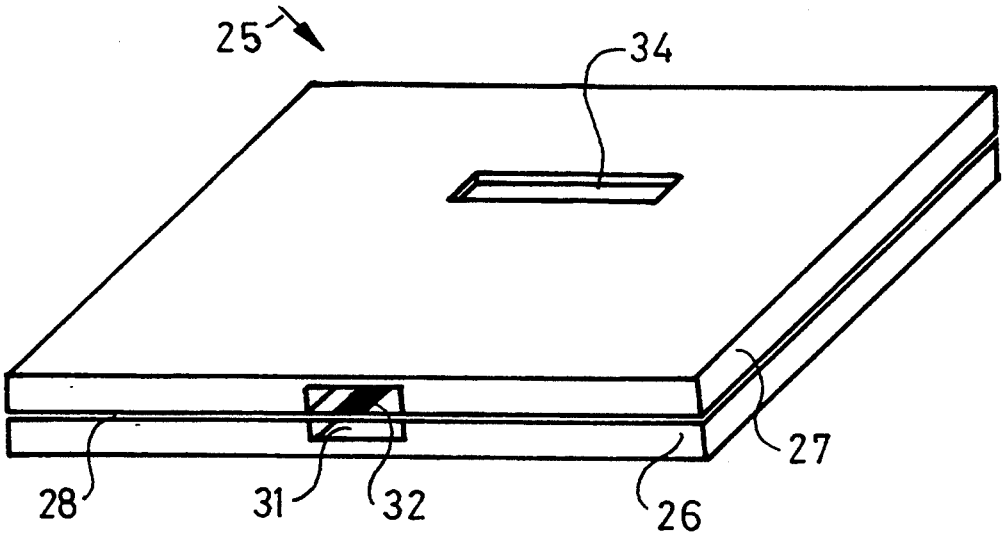
FIGS. 7 and 8 are respectively a perspective view and a view in axial section of an antenna according to the invention.
Figure 8:
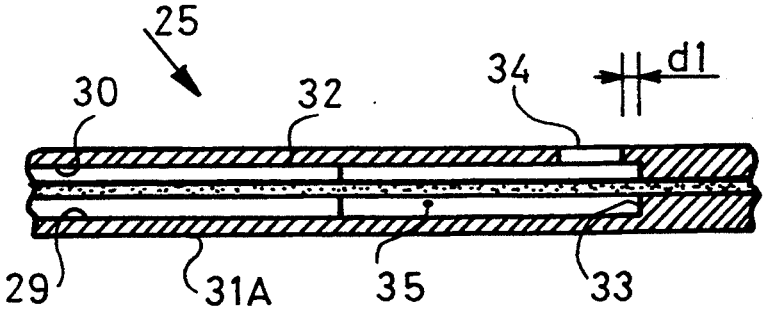

In FIGS. 7 and 8, an antenna 25 according to the invention has been represented. In these figures, only a single slot has been represented, but, of course, the same structure can comprise several slots, either fed independently of one another, or fed from the same source via distributors.

Figure 20:
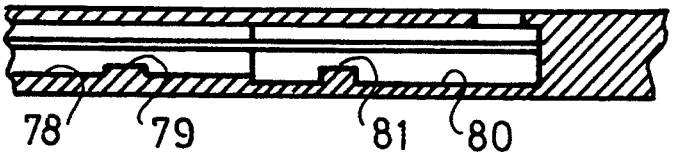
FIGS. 20 and 21 are views in section of other embodiments of the antenna according to the invention.

Antenna 25 is formed in two plates 26, 27, of electrically conductive material, assembled, by any suitable means, against one another with insertion of a film 28 of dielectric material. In each of plates 26, 27, a groove 29, 30, respectively, is formed on a part of the length of these plates. These grooves can be rectilinear but need not to be. One of the ends of grooves 29, 30 ends at one of the sides of the corresponding plate. These grooves both have a rectangular section, their depth, less than $\frac{1}{8}$ of a wavelength, can be constant over their entire length or else can vary, for at least one of the grooves, as illustrated in FIG. 20, and their widths are equal. Preferably, the depths of grooves 29, 30 are equal to one another. Plates 26, 27 are assembled so that groove 29 is opposite groove 30.

Figure 17:
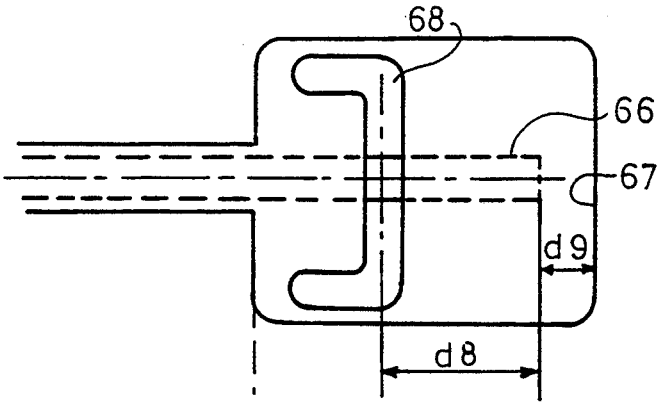

There is formed on one of the faces, or on both the faces of film 28 inside channel 31 defined by grooves 29 and 30, an electrically conductive strip 32 constituting the core of a stripline 31A therefore comprising channel 31 and core 32. The longitudinal axis of strip 32 is preferably merged with the longitudinal axis of channel 31. Core 32 can either extend up to closed end 33 of channel 31 (as represented in FIG. 8) and therefore be short-circuited with conductive plates 26, 27 or end slightly in front of this end, at a distance which provides protection from any breakdown (as represented in FIG. 17).

Slightly in front of end 33 of channel 31, a radiant slot, referenced 34 in FIGS. 7 and 8, is made in at least one of plates 26, 27. Various forms of slots are described below. In the simplest case, such as that illustrated by FIGS. 7 to 10, 12, 13, 15, 16, 23 and 26, the slot is rectilinear and perpendicular to the axis of channel 31, at least relative to the part of this channel which is close to the slot. This slot is of elongated rectangular shape, its ends preferably being rounded. In the case where the core of the stripline is short-circuited at end 33 of the channel (FIG. 8, for example), the slot is at a distance d1 from this end, d1 being less than $\frac{1}{8}$ of a wavelength. In the case where the end of the core of the stripline is open-circuited (FIG. 10), distance d2 between this end and the closed end of the channel is simply intended to assure a sufficiently high terminal impedance and distance LE between the axis of the slot and the end of the core is approximately equal to $\frac{1}{4}$ of a wavelength. The slot exhibits, on its average fiber, a length LF generally between about 0.4 and 0.6 of a working wavelength. Its width LA can be between 0 and about 0.1 of a working wavelength, this latter value is able to be higher when a single resonance mode can exist in the frequency band of use.

Figure 9:
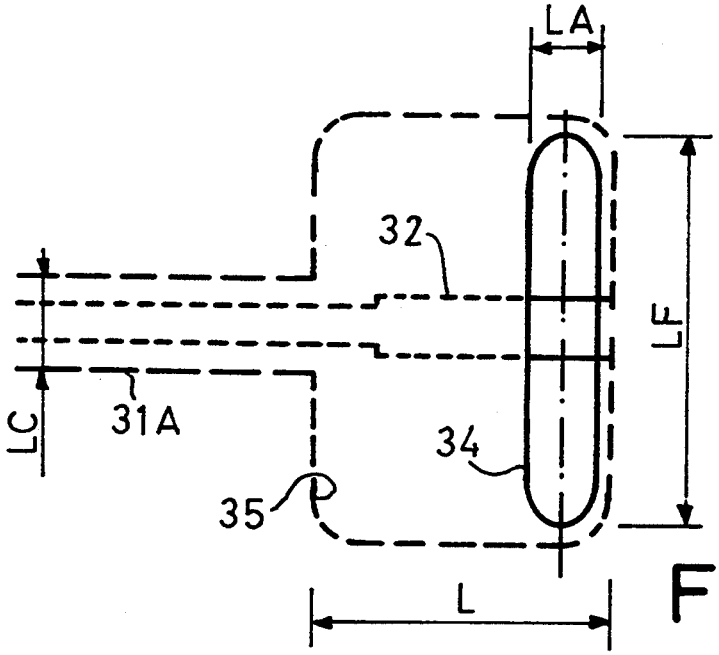

Of course, in the more general case (FIG. 9, for example), length LF of the slot is greater than width LC of channel 31. Consequently, the latter widens upstream from the slot, in an advantageous, but not required, way to about $\frac{1}{4}$ of a wavelength of the slot, and forms a cavity, referenced 35 in FIGS. 8 and 9. Core 32 can also widen close to slot 34, downstream from the beginning of cavity 35. In top view, as represented in FIG. 9, for example, cavity 35 can have an approximately rectangular shape, but it can have other shapes, as specified below.

Of course, length LF of slot 34 is a function of the wavelength used and is approximately equal to $\frac{1}{2}$ of a wavelength. The respective mutual dimensions, shapes and positions of the end of core 32, slot 34 and cavity 35 are parameters for adjustment to the design of the antenna, adaptation of impedances and, if necessary, adjustment of antenna networks, in particular for dense networks.

FIG. 10 illustrates the example where the end of the core is an open circuit with the distance LE between the axis of the slot and this end being approximately equal to $\frac{1}{4}$ of a wavelength.

The length LCAV and shape of cavity (35 or 37), the position of slot (34, 38) relative to this cavity, and the shape of the core are determined in the design of the antenna to obtain correct impedance adaptations between the line and the cavity and between the cavity and the slot.

As represented in FIGS. 11A and 11B, to reduce the surface of space requirement of the antenna, it is possible to fold the ends of the slot which thus has a "U" shape. In FIG. 11A, slot 41 assumes the shape of the end of cavity 42, and width d3 of the cavity is virtually equal to distance d4 between the outside faces of the branches of the "U" formed by the slot. Length d5 of the cavity is also determined to obtain a correct adaptation of the antenna. The actual length of slot 41 is actually the length of its average fiber F, between its two ends 43, 44.

In FIG. 11B, slot 41' has the same shapes and dimensions as those of slot 41, while cavity 42' is wider, but shorter than cavity 42.

As represented in FIG. 12, it can be advantageous, for installing the antenna more easily into a network, to decenter, by a value d6, axis 45 of line 46 relative to longitudinal axis 47 of cavity 48 (axis 47 passes through middle M of slot 49). Further, to adjust the impedance of the radiant slot relative to that of the line, it is possible to offset, by a value d7, end 50 of the core of the line. Value d7 can even be greater than d6.

As represented in FIG. 13, it is possible to vary the width of core 51 of the feeder of the antenna, close to cavity 52 and/or inside this cavity. It is possible, for example, to form on this core a narrowing 53 at the input of the cavity, then, over a short length, to form a widening 54 (whose width can be either equal to or different from that of the core of the line before the narrowing), and then to narrow the end 55 of the core. The width variations of the core can be abrupt or gradual. Such width variations of the core introduce, in a way known in the art, either reactive (inductive or capacitive) effects or impedance transformation effects (in particular by constituting a quarter-wave transformer).

According to the embodiment of FIG. 14, to produce a dead short circuit between the two conductive plates of the stripline structure around the cavity, it is possible to form metallized holes 56 in film 57 of this structure, all around the perimeter delimiting channel 58 of the line and cavity 59. The mutual distance from these holes is less than $\frac{1}{8}$ of a wavelength.

According to FIG. 15, cavity 60 has an approximately triangular shape (in top view) widening gradually from channel 61 of the feeder to slot 62. According to FIG. 16, cavity 63 has a circular shape (in top view). Slot 64 can pass through the center of this cavity. The end of core 65 of the feeder can be, as represented in this FIG. 16, open-circuited, but of course, as for all the embodiments of the antenna of the invention, this end can also be short-circuited.

Another embodiment with the end of open circuited core 66, cavity 67 having a rectangular shape and slot 68 having a "U" shape, has been represented in FIG. 17. Distance d8 between the axis of the central branch (that which is perpendicular to the axis of core 66 of the slot and the end of core 66 is approximately equal to $\frac{1}{4}$ of a wavelength.

Figure 18:
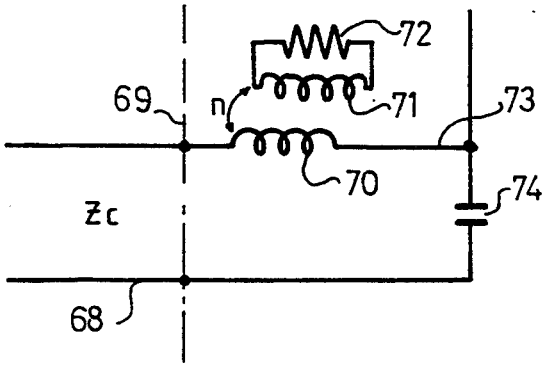
FIG. 18 is an equivalent electrical diagram of the antenna of FIG. 17.

In FIG. 18, the simplified equivalent electrical diagram of the embodiments at the end of the open-circuited core has been represented. This diagram comprises a characteristic impedance line Zc, which corresponds to the feeder of the antenna, and continues beyond beginning 69 of cavity 67 up to slot 68, equivalent to an inductance 70 in series in the line, coupled to an inductance 71 in parallel with a resistance 72. The line ends by a section 73 of a length approximately equal to $\frac{1}{4}$ of a wavelength, which is confined to a capacitance 74 which is equivalent to the open end of the line, the value of this capacitance being, among others, a function of distance d9 between the end of the core and the cavity.

Figure 19:
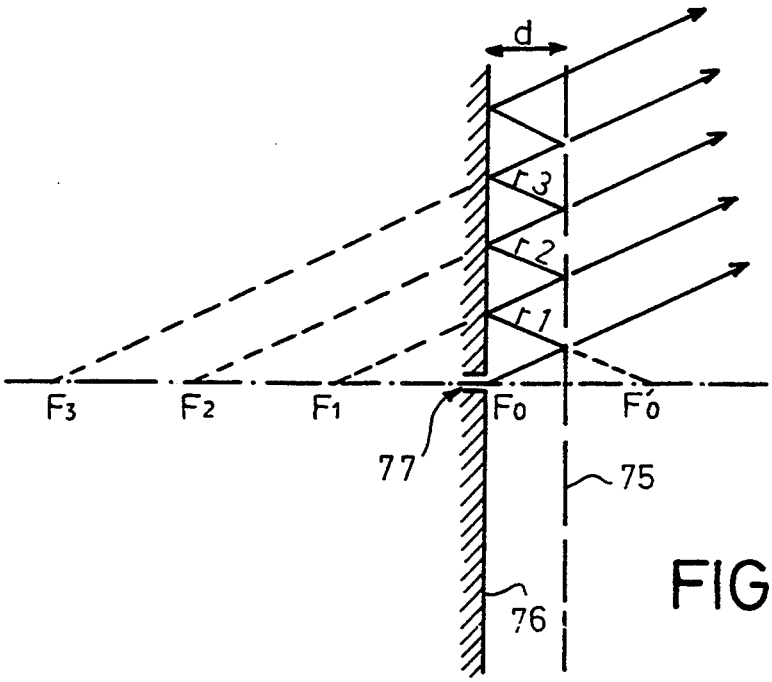
FIG. 19 is a diagrammatic view in section of an antenna according to the invention, with a partial reflector.

It is possible, as shown in FIG. 19, to combine a partial reflector 75, known in the art, placed parallel to metal plane 76 in which slot 77 is made, with the antenna of the invention (in any of its embodiments). The radiant slot thus profits by an image effect which can increase its directivity. The middle of the slot has been referenced Fo, and the successive images of Fo have been referenced F1, F2, F3, . . . after successive reflections (r1, r2, r3, . . . ) of the wave emitted on reflector 75. This partial reflector can be produced either with a dielectric wall of suitable thickness and permittivity (see, for example, "Image element antenna array for a monopulse tracking system for a missile," U.S. Pat. No. 3 990 078 Nov. 2, 1976, E. C. Belee, R. C. Breithaupt, D. L. Godwin and S. H. Walker, and "A highly thinned array using the image element," B. H. Sasser (Motorola), Symposium on Antennas and Propagation, September 1980, Quebec), or with a metal grid or its complement ("Partially reflecting sheet arrays," G. Von Trentini, IRE Transactions on Antennas and Propagation, October 1956, p. 666 and "Leaky-wave multiple dechroic beam formers, " J. R. James and coauthors, Electronic Letters, Aug. 31, 1989, Vol. 25, no. 18, p. 1209), or else in multiple combinations as described in "Microwave cavity antennas, "A. Kuwar and H. D Hristov, Artech House, 1989, Chap. 3). Of course, the various adjustment parameters of the antenna mentioned above should take into account the presence of this partial reflector placed in front of the radiant slot. Distance d between reflector 75 and plane 76 is about half a wavelength.

As represented in FIG. 20, it is possible to modify by locations the height of channel 78 ("step" 79) and/or cavity 80 ("step" 81). Such local modifications of the height of the channel and/or of the cavity produce the same type of effects as the variations of width of the core, described above with reference to FIG. 13. It thus is possible, by modifying all these different parameters, to optimize the operation of the antenna of the invention in the widest possible frequency band.

Figure 21:
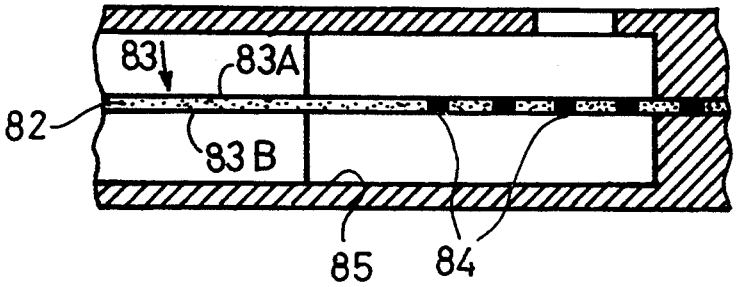

According to FIG. 21, the two faces are metallized with film 82 of a stripline structure to form core 83, and two faces 83A, 83B of this core are connected together, forming metallized holes 84 there, preferably regularly spaced, according to a span less than $\frac{1}{8}$ of a wavelength. These metallized holes can be formed only in the part of the core which is in cavity 85, or else over the entire length of the core.

Figure 22:
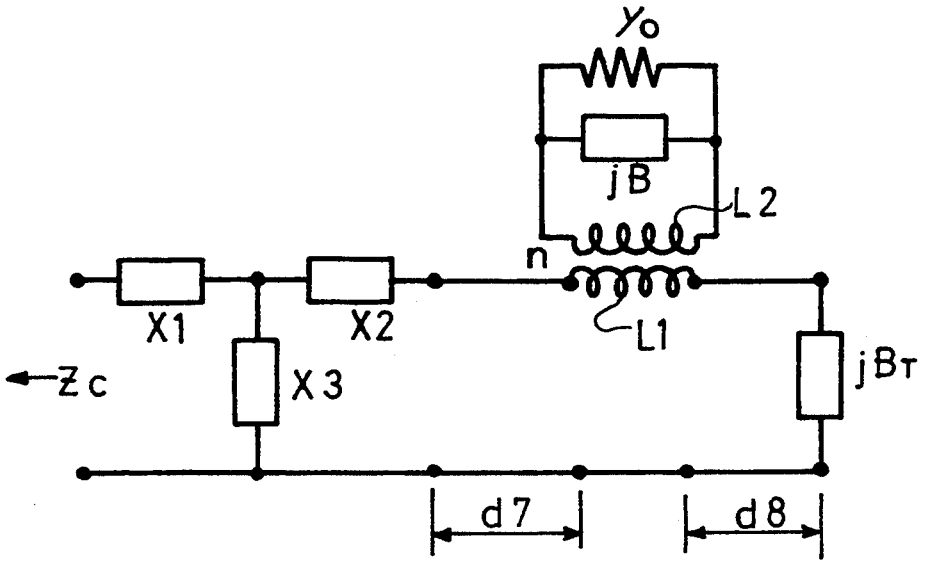
FIG. 22 is an equivalent electrical diagram of an antenna according to the invention.

In FIG. 22, the equivalent electrical diagram of the antenna of the invention has been represented. Characteristic impedance feeder Zc reaches a quadripole (xl, x2, x3) which represents the input quadripole in the cavity (transition between the channel of the line and the cavity). This quadripole is followed by a line section of length d7, representing the distance between the input of the cavity and the slot. The slot is equivalent to a series inductance L1 coupled to an inductance L2 in parallel on a reactance jB and a resistance Yo. Downstream from the slot, a line section of length d8 is confined to a reactance jBt (open circuit or short circuit, at a distance d7 from the slot).

Figure 23:
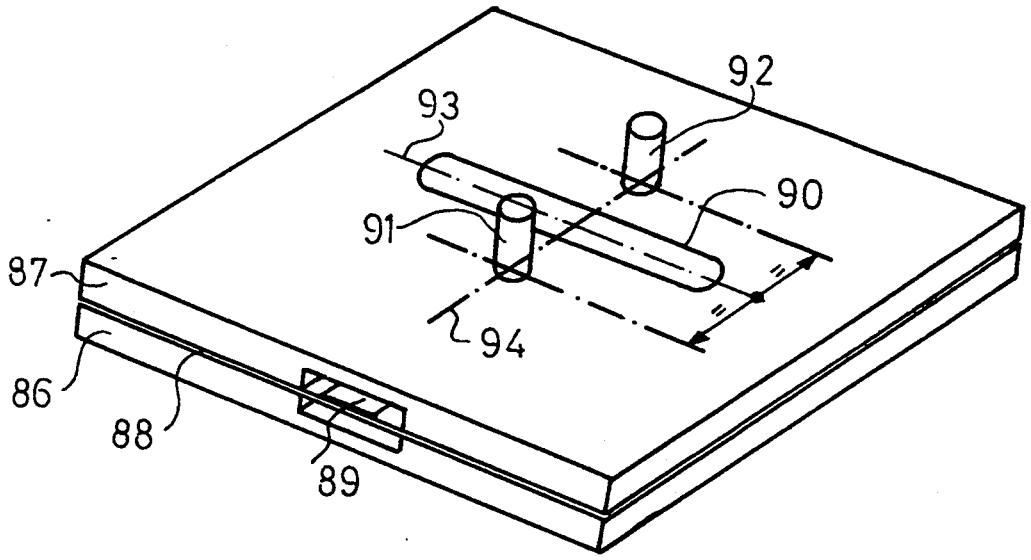
FIG. 23 is a perspective view of a variant of the antenna according to the invention.

The embodiment of FIG. 23 comprises the elements already described above: plates 86, 87 and film 88 on which core 89 is formed. The slot, made in plate 87, is referenced 90. This slot, as well as the cavity (not visible in the figure) can exhibit any of the characteristics described above. Two monopoles 91, 92, equidistant from axis 93 of the slot and placed on an axis 94 perpendicular to axis 93 and passing through the middle of slot 90, are shaped or attached to plate 87. These two monopoles 91, 92, for example, are straight frusta of cylinders, perpendicular to plate 87, hollow or solid, whose diameter is approximately equal to 1/10 of the length of slot 90 and whose height is approximately equal or less than $\frac{1}{4}$ of a wavelength. Such monopoles are known in the art (for example, according to "An improved element for use in array antenna, " A. Clavin, D. A. Huebner and F. J. Kilburg, IEEE Transactions on antennas and propagation, AP22, no. 4, July 1974, p. 521). These monopoles make it possible to increase the directivity of radiant slot 90 and/or to reduce its coupling to adjacent slots, if this slot forms part of a network.

Figure 24:
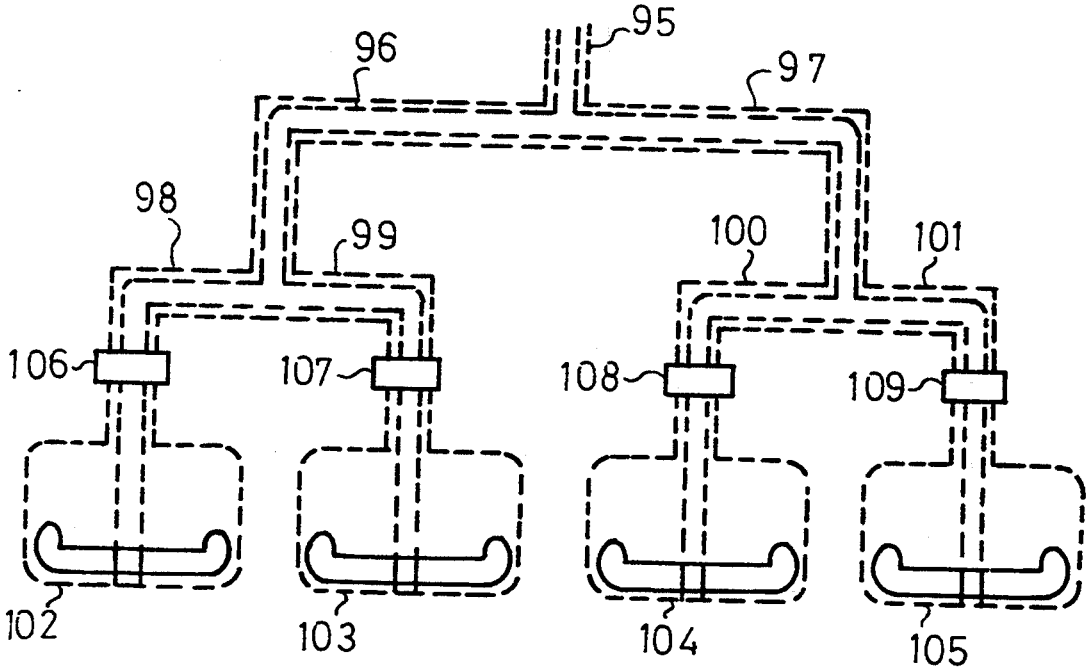
FIG. 24 is a simplified top view of an antenna network according to the invention.

In FIG. 24, a simplified example of feeding a slot network from a common line 95, has been represented, the network here comprising four slots, has been represented, but of course, their number can be greater than this value. Line 95 is subdivided into two branches 96, 97 which are each subdivided in turn into two "subbranches 98, 99 and 100, 101. The common line, the branches and the subbranches are produced in the same way as the line of FIG. 5. These four subbranches each feed a slot, respectively 102, 103, 104 and 105. A hyperfrequency circuit, respectively 106, 107, 108 and 109, is inserted in each of these subbranches. These hyperfrequency circuits are, for example, phase shifters, but can as well be amplifiers or attenuators. Of course, such hyperfrequency circuits can just as well be inserted in branches 96, 97 or in line 95.

Figure 25:
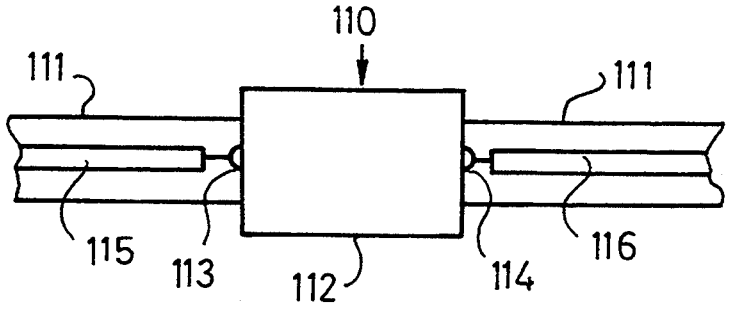
FIG. 25 is a simplified view in section of an embodiment detail of the network of FIG. 24.

In FIG. 25, a method for installing a hyperfrequency element 110 (phase shifter, amplifier, mixer, attenuator, etc. . . . ) in a line 111 (such as one of lines 95 to 101) of the invention has been represented. Line 111 is cut or interrupted over a length that is just sufficient to insert element 110. This element 110 can be produced according to any suitable hyperfrequency technology, for example, in microstrip technology on alumina substrate, and is enclosed in a package 112 of electrically conductive material. Input and output terminals 113, 114 of element 110 are, for example, glass beads through which conductors pass and which are attached to package 112. Ends 115, 116 of the core interrupted by line 111 are directly connected (for example, by soldering or metallization) to terminals 113, 114, which are, of course, placed in the plane of the core. Thus, the advantage of small losses of the suspended stripline and that of the compactness of element 110 are retained.

Figure 26:
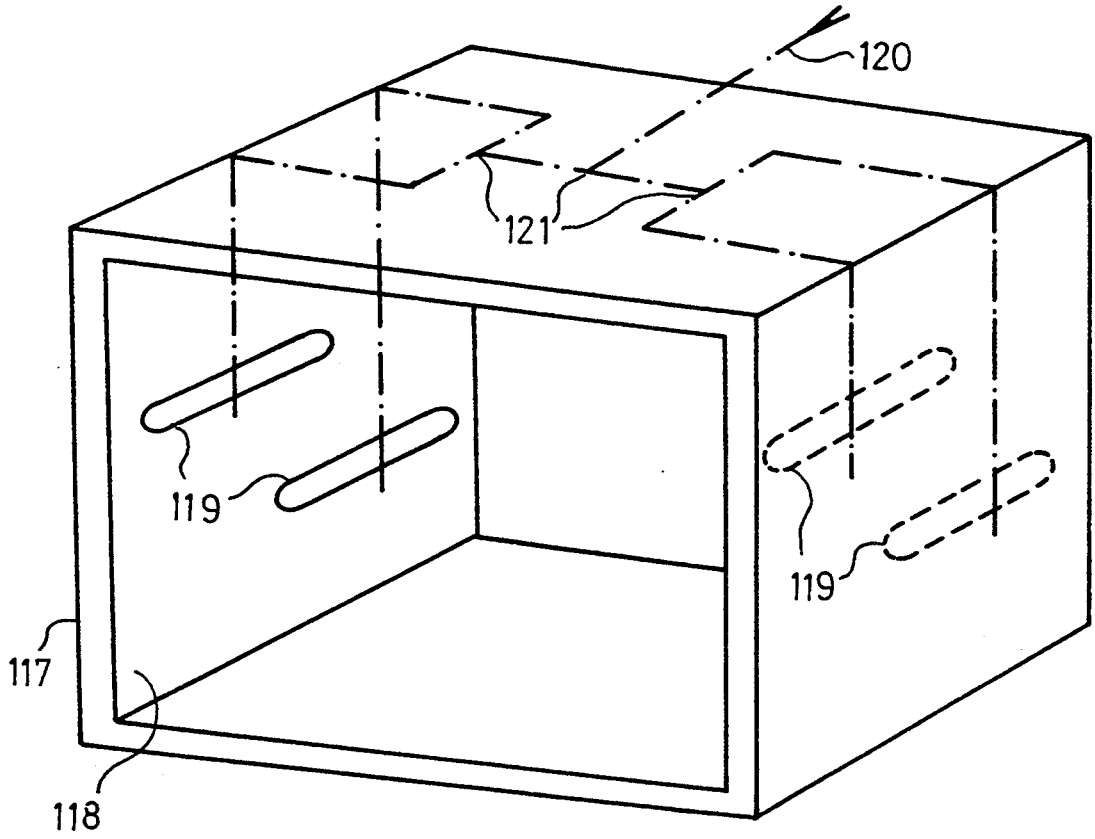
FIG. 26 is a simplified perspective view of a microwave heating unit comprising antennas according to the invention.

A microwave heating chamber 117 (i.e., operating in hyperfrequency) has been represented in a simplified way in FIG. 26. On the inside wall of chamber 117, a stripline structure 118 (not represented in detail) is formed, so that the latter assumes the shape of these walls. This structure comprises several slots 119 placed at suitable locations of the walls to obtain the homogeneity or the desired heating power distribution. These slots are fed from a common line 120 via distributors 121. It is also possible to use the antenna of the invention in a medical hyperthermia device.

In practice, the stripline structure of the invention is produced by forming two half-channels in two adjacent plates, the latter enclosing a metallized dielectric film. The assembly of the two plates is performed by bolts, rivets or any other process.

The film can be produced from any material of specialized trade (trademarks: Duroid, Cuclad, etc. . . .) whose composition is generally a resin (polytetrafluoroethylene, polyimides, etc. . . . ) which may be laden with glass fibers (woven or with random distribution). The metallization of the film can be single or double face; the latter choice being advantageous from the viewpoint of losses and of decoupling with an adjacent channel.

Short-circuiting of the two plates forming the channel of the stripline is assured by metallized holes (see FIG. 14). Also, metallized holes can be useful for assuring the electrical symmetry during the use of a double face stripline core (FIG. 21).

The shape of the cavity, as it is given in FIG. 9, is not limiting, the radius of curvature of the angles depends on the production technology of the plates: it can go from a zero value (sharp edge) to a value compatible with the presence of the slot (see FIG. 11*a*).

Figure 2:
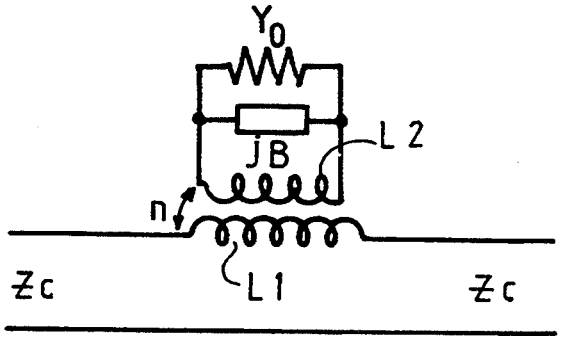
FIG. 2 is an equivalent electrical diagram of the antenna of FIG. 1.

The slot, which is cut in a plane crosswise to the propagation, intercepts the longitudinal lines of the current and consequently models as an impedance in series according to the standard diagram of FIG. 2. In the particular case of the invention, the line is ended by a purely reactive impedance, which is a short circuit in the preferred case of FIG. 9 or an open circuit in the instance of FIGS. 10, 16 or 17. In the general case, the diagram of FIG. 2 becomes, in the scope of the invention, that of FIG. 22 where a transition quadripole is introduced between the "suspended stripline" and the cavity coupled to the slot. In the hypothesis where other reactive or transformer elements would be used to adjust the load impedance to that of the line, these other elements will be substituted into this diagram.

For the development, three methods are possible according to the means available to the user:

1. Characterization of various elements of the equivalent diagram of FIG. 22:

attempts are made to evaluate, either by mathematical means (modal analysis or the like) or by measures with the network analyst, each of the elements of the diagram: impedance transformer, reactive discontinuities . . . , each of the elements is introduced whose dependence relative to its geometry is then known, in an optimization calculation (the criterion being the relative stability of the impedance exhibited at the line in a given frequency band). The latter assumes that there is no interdependence between the terms of the diagram other than that modeled: thus, the couplings by evanescent modes are excluded, which, in a structure as compact as that mentioned, is insufficient.

2. Strictly experimental development:

A knowledge of the dependence of certain terms is assumed a priori as a function of the geometry (examples: length of resonance of the slot, impedance of the slot as a function of the offset of the excitation line, etc. . . .).

An optimization by an approach that is logical and convergent toward the objective is assumed: the "try and cut" method.

3. Development with the computer.

For a given geometry, the distribution of the field and currents in the structure can be calculated, for example, by the method of finished elements: the impedance relative to the line is deduced from it. By successive finishing operations on the geometry, a converging should be made toward the selected optimal criterion (the smallest possible thickness of the stripline structure). It is a digital "try and cut" method.

Above, there was no mention of the partial reflector, it is understood that the definition of the slot impedance seen by the line takes into account the influence of this reflector. Further, the definition of this reflector assuring an increase of given directivity obeys the known rules concerning the dielectric walls or the mechanical grids and dichroic networks.

The device of the invention is applicable in all the radiant structures where small losses of the feed circuit (use of the "suspended stripline") and a small thickness ("suspended stripline"+slot) are sought simultaneously.

This small thickness of the radiant structure is sought in particular in airborne equipment but can find its application each time its integration is facilitated in a piece of equipment where the space requirement in the direction of the radiation (or in its vicinity) poses a problem.

Obviously, numerous modifications and variations of the present invention are possible in light of the above teachings. It is therefore to be understood that within the scope of the appended claims, the invention may be practiced otherwise than as specifically described herein.

What is claimed is:

1. A slot hyperfrequency thin antenna including a suspended stripline type structure comprising:

a feeder having two plates of electrically conductive material with a dielectric film inserted between said plates and a channel formed therein;

a stripline having a core in said feeder, the end of the core penetrating a cavity, one of said plates having at least one slot extending through said one plate to form an opening into said cavity, with the depth of the cavity being approximately equal to the thickness of said channel of the feeder.

2. Antenna according to claim 1, further comprising a partial reflector placed parallel to said plate having at least one slot.

3. Antenna according to any one of claims 1 or 2, wherein the end of the core of the stripline is short-circuited with the wall of an end of the cavity.

4. Antenna according any one of claims 1 or 2, wherein the end of the core of the stripline is open-circuited.

5. Antenna according to any one of claims 1 or 2, wherein the slot is rectilinear.

6. Antenna according to one of the claims 1 or 2, wherein the ends of said at least one slot are folded.

7. Antenna according to any one of the claims 1 or 2, wherein the longitudinal axis of the feeder is offset relative to the longitudinal axis of cavity.

8. Antenna according to any one of claims 1 or 2, wherein the end of the core of the feeder is offset relative to middle (M) of slot.

9. Antenna according to any of claims 1 or 2, wherein the width of the end of the core of the feeder is variable.

10. Antenna according to any one of the claims 1 or 2, wherein the thickness of the end of the channel of the feeder and/or of the cavity exhibit variations.

11. Antenna according to any one of the claims 1 or 2, wherein said dielectric film comprises metallized holes on the circumference of said channel and/or cavity, putting into electric contact the two electrically conductive plates of the stripline around the cavity and/or the channel.

12. Antenna according to any one of the claims 1 or 2, wherein at least the end of the core of the stripline comprises a double face metallization of the film of the stripline.

13. Antenna according to one of the claims 1 or 2, further comprising two monopoles placed perpendicular to an outside surface of said plate having said at least one slot, said two monopoles being placed so that there is one monopole on each side of said at least one slot.

14. Antenna according to any one of the claims 1 or 2, wherein said feeder further comprises a package containing a hyperfrequency element.

15. Antenna according to claim 14, wherein the element is a phase shifter.

16. Antenna according to claim 14, wherein the element is a mixer.

17. Antenna according to claim 14, wherein the element is an attenuator.

18. Antenna according to claim 14, wherein the element comprises an amplifier.

* * * * *